US011224888B2

(12) United States Patent
Kang et al.

(10) Patent No.: US 11,224,888 B2
(45) Date of Patent: Jan. 18, 2022

(54) FLUID CONTAINER

(71) Applicant: YONWOO CO., LTD., Incheon (KR)

(72) Inventors: Se Kyu Kang, Incheon (KR); Young Moo Bae, Incheon (KR); Ki Baik Kim, Incheon (KR)

( * ) Notice: Subject to any disclaimer, the term of this patent is extended or adjusted under 35 U.S.C. 154(b) by 0 days.

(21) Appl. No.: 16/967,314

(22) PCT Filed: Feb. 22, 2018

(86) PCT No.: PCT/KR2018/002186
§ 371 (c)(1),
(2) Date: Aug. 4, 2020

(87) PCT Pub. No.: WO2019/151563
PCT Pub. Date: Aug. 8, 2019

(65) Prior Publication Data

US 2021/0031222 A1 Feb. 4, 2021

(30) Foreign Application Priority Data

Feb. 5, 2018 (KR) ..... 10-2018-0013925

(51) Int. Cl.
*B05B 11/00* (2006.01)
*A45D 34/04* (2006.01)

(52) U.S. Cl.
CPC ..... *B05B 11/3004* (2013.01); *B05B 11/3043* (2013.01); *B05B 11/3052* (2013.01); *A45D 34/04* (2013.01); *A45D 2200/055* (2013.01)

(58) Field of Classification Search
CPC ..... B05B 11/3004; B05B 11/3043; B05B 11/3052; B05B 11/3069; B05B 11/00416; A45D 34/04; A45D 2200/055
USPC ..... 222/401
See application file for complete search history.

(56) References Cited

U.S. PATENT DOCUMENTS

| | | | | |
|---|---|---|---|---|
| 4,728,008 | A * | 3/1988 | Graf | B05B 11/3001 222/321.5 |
| 5,437,397 | A * | 8/1995 | Fuchs | B05B 11/02 222/321.9 |
| 6,769,576 | B2 * | 8/2004 | Ichikawa | B05B 11/3001 222/321.5 |
| 8,348,096 | B2 * | 1/2013 | Greiner-Perth | B05B 11/00412 222/50 |
| 2009/0283546 | A1 * | 11/2009 | Harrold | B05B 11/3092 222/256 |
| 2017/0265624 | A1 | 9/2017 | Wilson et al. | |

FOREIGN PATENT DOCUMENTS

| | | | |
|---|---|---|---|
| EP | 1671705 | A1 | 6/2006 |
| JP | 2008-296987 | A | 12/2008 |
| JP | 2014-213883 | A | 11/2014 |
| KR | 10-2004-0004851 | A | 1/2004 |

(Continued)

*Primary Examiner* — Vishal Pancholi
(74) *Attorney, Agent, or Firm* — Novick, Kim & Lee, PLLC; Sang Ho Lee; HyunWoo Shin

(57) ABSTRACT

Provided is a fluid container including: a container main body, of which one side is open, configured to store a fluid; a housing having an outlet provided at one side and in which the container main body slides in a longitudinal direction; and a pump module coupled to the open one side of the container main body and configured to discharge the fluid to the outlet by sliding the container main body.

6 Claims, 5 Drawing Sheets

(56) References Cited

FOREIGN PATENT DOCUMENTS

| | | | | |
|---|---|---|---|---|
| KR | 10-0766797 | B1 | | 10/2007 |
| KR | 100766797 | | * | 10/2007 |
| KR | 10-2012-0032135 | A | | 4/2012 |
| KR | 20-2013-0001155 | U | | 2/2013 |

* cited by examiner

FLUID CONTAINER

TECHNICAL FIELD

The present invention relates to a fluid container, and more particularly, to a fluid container capable of reducing a manufacturing cost and implementing stabilized pumping performance.

BACKGROUND ART

Generally, fluids, such as cosmetic fluids, are stored in a container having a specific accommodation space, discharged by an appropriate amount through an outlet, which is opened by separating a cover, and then directly transferred to the skin or indirectly transferred to the skin using a cosmetic tool so as to be used.

For example, a fluid is held in a contractible tube and sold, and, when a user removes a cover coupled to the tube and presses the tube in a direction in which the tube is compressed, a portion of the fluid may be discharged through an outlet provided at a tip of the tube.

However, there are problems in that, when a container itself is pressed to discharge a fluid, it is inconvenient because a discharged amount is not constant, and when there is a small amount of fluid remaining in the container, the container should be squeezed to discharge the fluid, but it is not possible to discharge all of the fluid remaining in the container.

Therefore, a pump may be used to address the above-described problems. The pump is a configuration that suctions a fluid and then discharges the fluid to the outside by pressure regulation. The pump uses a member such as a piston that moves up and down.

However, in order to suction a fluid inside a container through a negative pressure and discharge the fluid inside the pump to an outlet through a positive pressure, the pump inevitably has a structure in which a plurality of members are coupled.

Due to such a structure of the pump, there are problems in that the overall manufacturing cost and manufacturing time are increased and pumping performance may not be sufficiently secured according to the shape, arrangement, or connectional relationship of the members.

Therefore, for containers that discharge a fluid using a pump, continuous research and development have been carried out to simplify the structure of the pump while guaranteeing the pumping performance so that a manufacturing cost is reduced and a unit cost of the container is lowered.

DETAILED DESCRIPTION OF THE INVENTION

Technical Problem

The present invention is directed to providing a fluid container capable of significantly reducing a manufacturing time and manufacturing cost by modularizing and assembling a pump.

The present invention is also directed to providing a fluid container capable of improving a user's satisfaction by, while using a modularized pump, guaranteeing stabilized performance of the pump and preventing leakage of fluid therefrom.

Objectives of the present invention are not limited to the above-mentioned objectives, and other unmentioned objectives should be clearly understood by those of ordinary skill in the art from the description below.

Technical Solution

An embodiment of the present invention provides a fluid container including: a container main body, of which one side is open, configured to store a fluid; a housing having an outlet provided at one side and in which the container main body slides in a longitudinal direction; and a pump module coupled to the open one side of the container main body and configured to discharge the fluid to the outlet by sliding the container main body.

The fluid container may further include a cap coupled to the open one side of the container main body and having an opening, and the pump module may be integrally coupled to the opening of the cap and disposed between the cap and the outlet.

The pump module may include: a cylinder coupled to the opening of the cap and having an inlet communicating with an inner portion of the container main body; a piston provided at an inner wall of the cylinder; a sealing part coupled to a circumference of an upper end of the cylinder to suppress upward movement of the piston; a stem having an inlet port, which is opened and closed by the piston, formed at one end and which is connected to the outlet of the housing; and an elastic member configured to provide an elastic force to the sealing part in a direction moving away from the outlet, wherein the pump module may be coupled to the opening of the cap in a state in which the cylinder and the sealing part are coupled.

The container main body may include a button part exposed to the outside of the housing and configured to be pressed to allow sliding of the container main body.

The pump module may further include a shaft coupled to the stem to integrally move up and down with the stem and fitted to the outlet.

In the pump module, when the button part is pressed and thus the container main body slides toward the outlet, the inlet port may be opened as the cylinder and the piston move upward, and then, due to an increase in an internal pressure of the cylinder, the fluid in the cylinder may be discharged to the outlet via the stem.

In the pump module, when pressing on the button part is released, as the container main body slides in the direction moving away from the outlet due to the elastic member, the inlet port may be sealed as the cylinder and the piston move downward, and then, due to a decrease in an internal pressure of the cylinder, the fluid inside the container main body may be introduced into the cylinder.

The cap may include a pump coupling part that protrudes from a circumference of the opening of the cap toward the outlet, and, as the cylinder is inserted into the opening of the cap and an edge part provided at the cylinder is engaged with the pump coupling part, the pump module may be coupled to the cap.

Effect of the Invention

According to the present invention, by using a method in which a pump module is integrally assembled to a cap of a container main body, a process of assembling the pump module and the container main body can become more convenient and simplified, and a unit cost of the product can be lowered.

In addition, according to the present invention, by using a pump module having a structure that stably secures pumping performance and allowing assembly of members constituting the pump module to be completed before assembling the pump module to the cap, sealing is guaranteed, and manufacturing efficiency is increased. In this way, there is an effect of reducing the cost burden on the user.

MODES OF THE INVENTION

Figure 1:
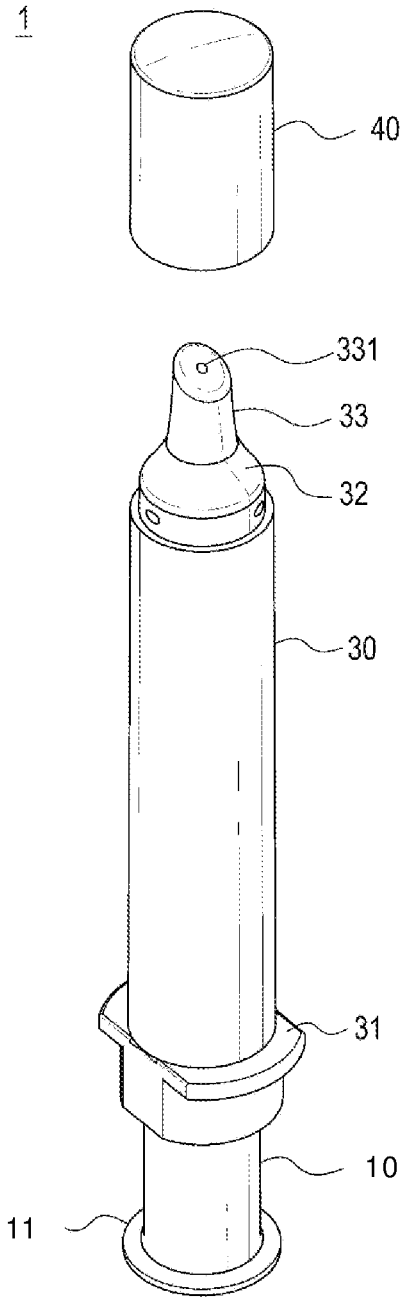
FIG. 1 is a perspective view of a fluid container according to an embodiment of the present invention.

Hereinafter, embodiments according to the present invention will be described with reference to the accompanying drawings. In giving reference numerals to elements in each drawing, it should be noted that like reference numerals are given to like elements as much as possible even when the elements are illustrated in different drawings. In addition, in describing the embodiments of the present invention, when detailed description of a known related configuration or function is deemed to impede the understanding of the embodiments of the present invention, the detailed description thereof will be omitted. Also, although the embodiments of the present invention will be described below, the technical idea of the present invention is not limited thereto, and the present invention may be modified and practiced in various other forms by those of ordinary skill in the art.

Throughout the specification, when it is mentioned that a certain portion is "connected" to another portion, this not only includes a case in which the certain portion is "directly connected" to the other portion, but also includes a case in which the certain portion is "indirectly connected" to the other portion while another element is disposed therebetween. Throughout the specification, when it is mentioned that a certain portion "includes" a certain element, this indicates that the certain portion may further include another element instead of excluding the possibility of further including another element unless otherwise stated. Also, terms such as first, second, A, B, (a), and (b) may be used to describe elements of the embodiments of the present invention, but the terms are only for distinguishing one element from another element and are not intended to limit the essence, order, sequence, or the like of the corresponding elements.

Figure 2:
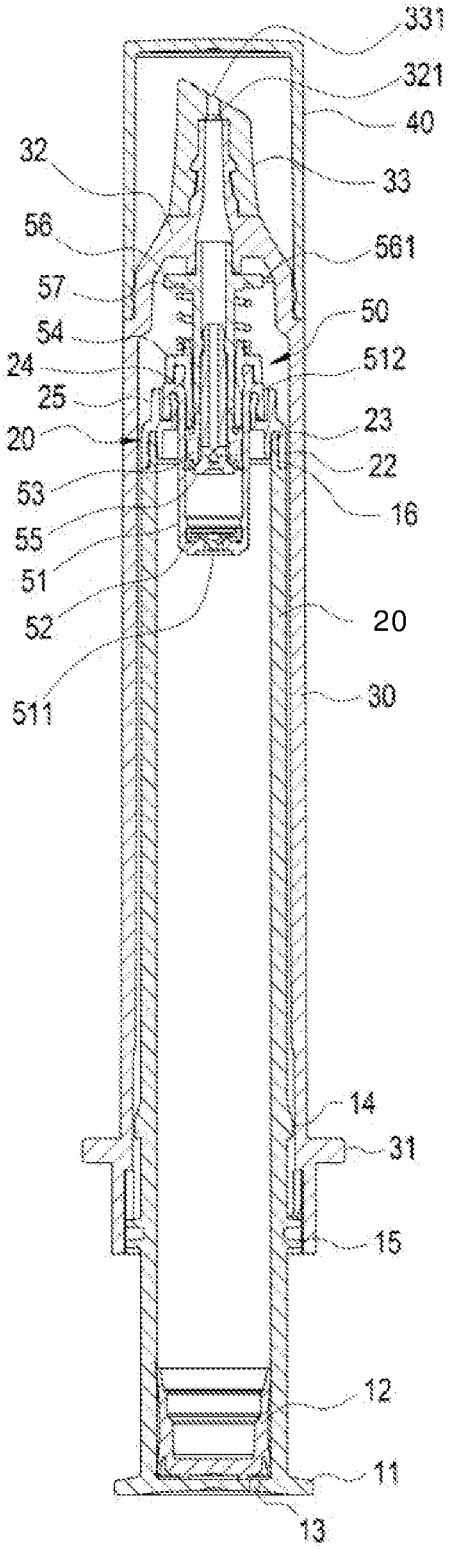
FIG. 2 is a cross-sectional view of the fluid container according to an embodiment of the present invention.
Figure 3:
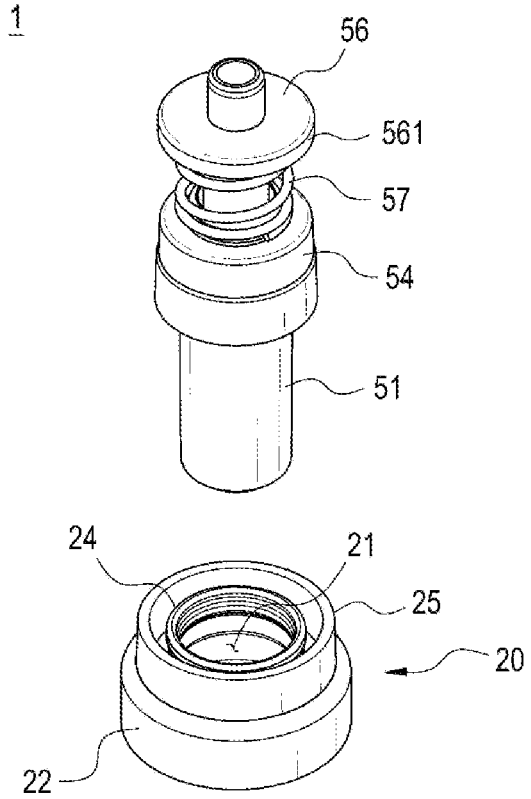
FIG. 3 is an exploded perspective view of a pump module and a cap of the fluid container according to an embodiment of the present invention.
Figure 4:
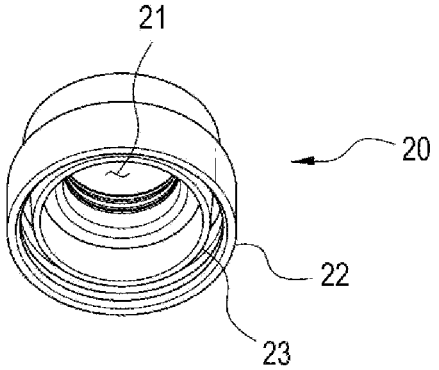
FIG. 4 is a perspective view of the cap of the fluid container according to an embodiment of the present invention.

FIGS. 1 and 2 illustrate a perspective view and a cross-sectional view, respectively, of a fluid container according to an embodiment of the present invention, FIG. 3 illustrates an exploded perspective view of a pump module and a cap of the fluid container according to an embodiment of the present invention, and FIG. 4 illustrates a perspective view of the cap of the fluid container according to an embodiment of the present invention.

Referring to FIGS. 1 to 4, a fluid container 1 according to an embodiment of the present invention includes a container main body 10, a cap 20, a housing 30, a cover 40, and a pump module 50. For convenience of description, vertical and horizontal directions mentioned below are based on the drawings, and the scope of the present invention is not necessarily limited by the corresponding directions.

The container main body 10 stores a fluid therein. The fluid stored in the container main body 10 may be a cosmetic fluid, a medicinal fluid, or a non-medicinal fluid such as toothpaste but may also be any other kinds of material that may be discharged by pumping.

The container main body 10 may have a shape that resembles a shape of the housing 30 which will be described below. For example, the container main body 10 and the housing 30 may have a shape of a long cylinder. Here, the container main body 10 slides in a longitudinal direction (vertical direction in the drawings) inside the housing 30, and, on the basis of the drawings, a lower side of the container main body 10 is exposed to the outside of the housing 30, and a button part 11 is provided at the lower side of the container main body 10 that is exposed to the outside.

The button part 11 is a portion to which a user applies an external force. When the user presses the button part 11, the container main body 10 slides upward. For example, the user may hold an outer surface of the housing 30 with one hand and press the button part 11 with the other hand to slide the container main body 10 or may hold a handle 31 protruding from the housing 30 like a syringe with an index finger and a middle finger and press the button part 11 with a thumb to slide the container main body 10.

The button part 11 may be configured in a shape having an area larger than an inner cross-sectional area of the housing 30 that accommodates the container main body 10. That is, in order to prevent the button part 11 from entering the housing 30 even when the container main body 10 slides, the button part 11 may be configured to have a size larger than a size of the inner cross-section of the housing 30.

A pressing part 12 is provided in the container main body 10. As the fluid stored in the container main body 10 is consumed, the pressing part 12 may push the fluid upward. The pressing part 12 maintains a state of being adhered to an inner wall of the container main body 10. When the fluid is discharged and thus the volume of the fluid in the container main body 10 decreases, the pressing part 12 moves upward corresponding thereto.

In order to allow the pressing part 12 to move upward smoothly, an air inlet hole 13 is formed at a lower end of the container main body 10, and the pressing part 12 is disposed between the air inlet hole 13 and the pump module 50. When the pressing part 12 moves upward by as much as the amount of discharged fluid, air is introduced into the container main body 10 through the air inlet hole 13. That is, since the fluid is stored in the container main body 10 in a state in which the container main body 10 is blocked from outside air by the pressing part 12, the pump module 50 of the present invention may be considered as an airless pump type.

An annular frame 14 may be formed at an outer wall of the container main body 10. The annular frame 14 may be a configuration that limits sliding of the container main body 10. That is, in one embodiment, in one region inside the housing 30, a lower-side cross-sectional area and an upper-side cross-sectional area may be implemented to be different and the upper-side cross-sectional area may be formed to be larger than the lower-side cross-sectional area, and an outer-side cross-sectional area of a portion of the container main body 10 where the annular frame 14 is formed may be implemented to be smaller than the lower-side cross-sectional area of the one region and larger than the upper-side cross-sectional area thereof.

In this case, when the container main body 10 slides toward an upper side of the housing 30, the annular frame 14 may be caught at one point in the upper side of the housing 30 where the cross-sectional area decreases. Therefore, the annular frame 14 may determine a sliding height of the container main body 10 and determine a stroke of the pump module 50.

Also, an adhering part 15 may be formed between the annular frame 14 and the pressing part 12 at the outer wall of the container main body 10, and the sliding of the container main body 10 may also be limited by the adhering part 15. That is, inside the housing 30, a point at which upward movement of the adhering part 15 is suppressed may be provided in addition to a point at which upward movement of the annular frame 14 is suppressed, and thus, as at least any one of the adhering part 15 and the annular frame 14 is caught at the point at which the cross-sectional area decreases inside the housing 30, upward movement of the container main body 10 may be limited.

In addition, the adhering part 15 may perform a function of maintaining balance of the container main body 10 so that the container main body 10 vertically slides upward inside the housing 30. That is, when the container main body 10 is pressed using the button part 11, due to a gap between the container main body 10 and the housing 30, the button part 11 may be shaken in the process in which the container main body 10 slides. However, according to the present invention, by the adhering part 15 being formed at a position in the vicinity of the button part 11 at the outer wall of the container main body 10, movement of the button part 11 may be prevented in the process in which the button part 11 is manipulated. Of course, the annular frame 14 may also perform the same function.

One side of the container main body 10 may be open. The open one side of the container main body 10 may be an upper side in the drawings and may be sealed as the cap 20 and the pump module 50 are coupled.

A step 16 may be formed at the open one side of the container main body 10. The step 16 may be formed at the outer wall and/or inner wall of the container main body 10. The step 16 may be a configuration that is engaged with the cap 20, which will be described below, and, in one embodiment, the step 16 provided in the container main body 10 may have a size that allows an outer wall of the cap 20 coupled to the container main body 10 to be connected in parallel to the outer wall of the container main body 10. That is, in this case, an outer-side width of the step 16 may correspond to an inner-side width of an outer wall part 22 of the cap 20 coupled to the step 16.

The cap 20 is coupled to the open one side of the container main body 10 and has an opening 21. The pump module 50, which will be described below, may be coupled to the opening 21 of the cap 20. The outer wall part 22 and an inner wall part 23 may be provided along the circumference of the cap 20, and the cap 20 and the container main body 10 may be engaged and coupled so that the step 16 of the container main body 10 is disposed in the gap between the outer wall part 22 and the inner wall part 23. Here, a catching protrusion (not shown) may be formed at the outer wall part 22 and/or inner wall part 23, and a catching step 161 may be formed at the step 16 or the like so as to correspond to the catching protrusion. That is, when coupling the cap 20 to the container main body 10, when the cap 20 is fitted so that the catching protrusion is bound to the catching step 161, the cap 20 may be firmly coupled to the container main body 10.

In one embodiment, between the container main body 10 and the cap 20, primary sealing may be performed by the inner wall of the container main body 10 and the inner wall part 23 of the cap 20, and secondary sealing may be performed by the step 16 of the container main body 10 and the outer wall part 22 of the cap 20. Of course, instead of sealing a portion where the container main body 10 and the cap 20 are connected, the container main body 10 and the cap 20 may be provided as one body.

The cap 20 may have a pump coupling part 24 which protrudes upward toward an outlet 321 from the circumference of the opening 21. Since the above-described outer wall part 22 and the inner wall part 23 may protrude downward toward the container main body 10, a protruding direction of the outer wall part 22/inner wall part 23 and a protruding direction of the pump coupling part 24 may be opposite.

A cylinder 51 of the pump module 50 may be coupled to the pump coupling part 24. That is, according to the present invention, as the cylinder 51 is inserted into the opening 21, an upper-side edge part 512 of the cylinder 51 may be engaged to surround the pump coupling part 24 and allow the pump module 50 to be coupled to the cap 20. In this way, according to the present invention, when the pump module 50 in a state in which specific configurations (the cylinder 51, a piston 53, a sealing part 54, a stem 55, and the like), which will be described below, are coupled and modularized as one body is fitted to the opening 21 of the cap 20, since only coupling the pump module 50 to the pump coupling part 24 is necessary, the manufacturing process may be very quick and simple.

A groove 241 may be formed on an inner surface and/or an outer surface of the pump coupling part 24. A convex part (not denoted by a reference numeral) formed at an inner surface of the edge part 512 of the cylinder 51, which will be described below, may be bound to the groove 241 when the pump module 50 is coupled to the pump coupling part 24. Of course, according to embodiments to which the present invention is applied, various structures other than those described above may be adopted to maintain a coupling force between the pump module 50 and the pump coupling part 24.

In the cap 20, a circumferential part 25 may be further formed along the circumference of the pump coupling part 24 so as to be concentric with the pump coupling part 24. Here, the circumferential part 25 may be a configuration that wraps around the outer side of the cylinder 51 and may be a configuration that is adhered or not adhered to the cylinder 51.

The circumferential part 25 may guide the edge part 512 of the cylinder 51 when the pump module 50 is being coupled to the cap 20. To this end, an inner surface of the circumferential part 25 may be formed as an inclined surface, an inner diameter of which gradually decreases toward the lower end. However, since the circumferential part 25 is not involved in sealing, coupling of the pump module 50, or the like, the circumferential part 25 may be omitted according to embodiments, or sealing may be additionally performed at outer sides of the pump coupling part 24 and the edge part 512 by using the circumferential part 25.

The outlet 321 is provided at one side of the housing 30, and the container main body 10 slides in the longitudinal direction inside the housing 30. Like the container main body 10, the housing 30 may have a long cylindrical shape, and the handle 31 may be provided at the lower side of the housing 30.

That is, when the user holds the handle 31 and presses the button part 11 of the container main body 10 with a thumb or the like, the container main body 10 may move toward the outlet 321 inside the housing 30. Here, the shape of the handle 31 is not limited, and the handle 31 may have any shape as long as the shape allows the user to easily and conveniently push the container main body 10 toward the inner side of the housing 30.

Points where the cross-section changes are formed at the inner wall of the housing 30. The point at which the annular frame 14 of the container main body 10 is caught and the point at which the adhering part 15 of the container main body 10 is caught, which have been described above, may be selectively formed or both of the points may be formed. For example, the point at which the adhering part 15 of the container main body 10 is caught may be formed below the handle 31, and the point at which the annular frame 14 of the container main body 10 is caught may be formed above the handle 31, but the present invention is not limited thereto.

A mouth 32 may be provided at the upper side of the housing 30 that is opposite the handle 31, and the outlet 321 may be formed at the mouth 32. The mouth 32 may be formed in the shape of a sharp head in which a cross-section decreases in an upward direction, and the outlet 321 may also be formed in a shape in which a cross-section decreases in the upward direction.

A discharge tip 33 may be provided at the mouth 32. When the fluid is a cosmetic fluid, the discharge tip 33 may serve as an application part which directly comes into contact with the skin or the like to which the cosmetic fluid should be supplied. The discharge tip 33 may be a rigid body made of metal, a synthetic resin, or the like or may be made of a cushioning material such as foam or rubber.

A discharge port 331 may be formed in the discharge tip 33. The discharge port 331 communicates with the outlet 321 of the mouth 32. Here, a single discharge port 331 may be connected to a single outlet 321, or, according to embodiments, a plurality of discharge ports 331 may be formed in the discharge tip 33 and the plurality of discharge ports 331 may be connected to a single outlet 321.

The cover 40 covers the outlet 321 and/or discharge tip 33 of the housing 30. The cover 40 may be detachably coupled to a portion around the mouth 32 of the housing 30 and may be separated from the housing 30 by the user. The cover 40 may be formed in a cylindrical shape having a predetermined height so that the cover 40 may cover the mouth 32 and the discharge tip 33 of the housing 30, and, when the cover 40 is coupled to the housing 30, an outer surface of the cover 40 and the outer surface of the housing 30 may be smoothly continuous.

A step (not denoted by a reference numeral), a catching step (not denoted by a reference numeral), and the like may be provided at a circumference of the mouth 32 of the housing 30 in order to improve a coupling force of the cover 40, but this is merely illustrative, and, of course, other structures used for detaching the cover 40 may be applied in various ways.

The pump module 50 is coupled to the open one side of the container main body 10 and discharges the fluid to the outlet 321 when the container main body 10 slides. The pump module 50 may be integrally coupled to the opening 21 of the cap 20 and disposed between the cap 20 and the outlet 321 inside the housing 30 or may be separately manufactured in the form of a single module. That is, according to the present invention, without being required to assemble the specific configurations constituting the pump module 50 during the process of assembling the container main body 10 and the cap 20, the pump module 50 that is already complete may be assembled to manufacture the fluid container 1, and thus, it is possible to prevent a delay in the overall assembly process due to the process of assembling the pump module 50 which has a small size and which may be difficult to assemble.

The pump module 50 includes the cylinder 51, the piston 53, the sealing part 54, the stem 55, a shaft 56, and an elastic member 57.

The cylinder 51 is coupled to the opening 21 of the cap 20 and has an inlet 511 which communicates with the inner portion of the container main body 10. Also, for coupling with the cap 20, the cylinder 51 has the edge part 512 formed around a circumference of an upper side, and the pump coupling part 24 of the cap 20 may be seated between an outer wall of the cylinder 51 and the edge part 512. That is, as the cylinder 51 is inserted into the opening 21 of the cap 20, the outer wall of the cylinder 51 and the edge part 512 may be fitted to surround the inner surface and outer surface of the pump coupling part 24 and may allow the pump module 50 to be coupled to the opening 21 of the cap 20. To this end, the opening 21 of the cap 20 may be formed to have a size that is greater than or equal to a cross-sectional size of the cylinder 51.

For coupling of the sealing part 54, a groove 513 may be formed in the inner wall of the cylinder 51. As will be described below, the cylinder 51 and the sealing part 54 may be firmly coupled to each other using the groove 513. To this end, the groove 513 is disposed above a portion where the piston 53 is disposed at the inner wall of the cylinder 51.

The inlet 511 of the cylinder 51 may be formed at the center of a lower end toward the inner potion of the container main body 10, and a valve 52 may be provided at the inlet 511. The valve 52 is a backflow-preventing valve 52 and seals the inlet 511 when an internal pressure of the cylinder 51 is a positive pressure and then is lifted upward and opens the inlet 511 when the internal pressure of the cylinder 51 is changed to a negative pressure.

The piston 53 is provided at the inner wall of the cylinder 51. The piston 53 may be provided in a state in which the piston 53 attempts to maintain a predetermined position at the inner wall of the cylinder 51 by a frictional force. Therefore, when there is no external force, the piston 53 may vertically move together with the cylinder 51. The piston 53 may be configured to have an H-shaped cross-section, and an outer surface of the piston 53 may come in contact with the inner wall of the cylinder 51 at two or more sites so that a sufficient frictional force is secured. Also, an inner surface of the piston 53 may be in contact with the stem 55, but the shape of the piston 53 may be determined so that a frictional force acting on the outer surface of the piston 53 is higher than a frictional force acting on the inner surface of the piston 53.

The piston 53 may open or close an inlet port 551 formed in the stem 55. Specifically, a lower end of the inner surface of the piston 53 may be adhered to a base part 552 of the stem 55 and seal the inlet port 551. When the piston 53 moves upward with respect to the stem 55, a portion between the lower end of the inner surface of the piston 53 and the base part 552 of the stem 55 may be opened, and the inlet port 551 may communicate with the inner portion of the cylinder 51. The process in which the inlet port 551 is opened and closed will be described in detail below with reference to FIGS. 5 to 8.

The sealing part 54 is coupled to a circumference of an upper end of the cylinder 51, and a lower end of the sealing part 54 is configured to extend to an inner side of the cylinder 51 so that upward movement of the piston 53 is suppressed. The sealing part 54 may have an edge part 541 formed around a circumference thereof, and the cylinder 51 and the sealing part 54 may be coupled as the upper end of the cylinder 51 is inserted between an outer wall of the sealing part 54 and an inner wall of the edge part 541.

The sealing part 54 is indirectly coupled to the cap 20 through the cylinder 51 instead of being directly coupled to the cap 20. That is, since the pump module 50 is implemented to be integrally coupled to the cap 20 in a state in which the specific configurations, such as the cylinder 51 and the sealing part 54, of the pump module 50 are coupled to each other, it is possible to reduce the manufacturing time and manufacturing cost. Also, in order to be firmly coupled to the cylinder 51 and vertically move together with the cylinder 51, the sealing part 54 may include a protruding part 542 formed at a portion corresponding to the groove 513 of the cylinder 51 so as to be bound to the groove 513.

A gap may be formed between the inner surface of the sealing part 54 and the shaft 56, which will be described below, in order to allow movement of the sealing part 54 with respect to the shaft 56. Of course, in this case, a separate member for sealing may be provided to prevent the fluid from leaking through a portion between the sealing part 54 and the shaft 56.

As described above, the cylinder 51 and the sealing part 54 are configurations directly or indirectly coupled to the cap 20 of the container main body 10. When the button part 11 is pressed to slide the container main body 10, the cylinder 51 and the sealing part 54 move along with movement of the container main body 10.

The stem 55 has the inlet port 551, which is configured to be opened or closed by the piston 53, provided in the outer surface at the lower side and is connected to the outlet 321 of the housing 30. The lower side of the stem 55 may be surrounded by the inner surface of the piston 53, the upper side of the stem 55 may be connected to the outlet 321 through the shaft 56, and the stem 55 may move vertically relative to the cylinder 51 or the like.

The base part 552 may be provided at the lower end of the stem 55. The base part 552 may have a conical shape. When the lower end of the inner surface of the piston 53 is adhered to the base part 552, the inlet port 551 may be isolated from an inner space of the cylinder 51. On the other hand, when the piston 53 moves upward with respect to the base part 552, the lower end of the inner surface of the piston 53 may be separated from the base part 552, the inlet port 551 may be opened and communicate with the inner space of the cylinder 51, and the fluid inside the cylinder 51 may be introduced into the stem 55.

The stem 55 may be formed in the shape of a hollow tube. The lower side of the stem 55 may communicate with the inlet port 551, and the upper side of the stem 55 may communicate with the outlet 321 through the inner portion of the shaft 56. Therefore, a fluid may be introduced into the stem 55 through the inlet port 551 which is opened by the piston 53 and then may be discharged to the discharge port 331 of the discharge tip 33 via the shaft 56 and the outlet 321.

A lower end of the shaft 56 is integrally coupled to the stem 55, and an upper end of the shaft 56 is fitted to the outlet 321. A coupling structure between the shaft 56 and the stem 55 may use a protrusion (not denoted by a reference numeral) or the like as illustrated in the drawings, or the shaft 56 and the stem 55 may be coupled by forcibly fitting. Meanwhile, the shaft 56 and the stem 55 are described as separate configurations herein, but, of course, the shaft 56 and the stem 55 may also be integrally manufactured as one configuration.

A wing part 561 may be formed to protrude along an outer circumferential surface at a lower side of the upper end of the shaft 56. The wing part 561 may have an area larger than an area of the outlet 321 and limit a height at which the upper end of the shaft 56 is fitted to the outlet 321.

The elastic member 57 may be provided between the shaft 56 and the sealing part 54. That is, according to the present invention, an upper end of the elastic member 57 is adhered to a lower surface of the wing part 561, a lower end of the elastic member 57 is adhered to the upper surface of the sealing part 54, and an elastic force is applied to the sealing part 54 in a downward direction (that is, a direction moving away from the outlet 321), which means that the elastic member 57 presses the sealing part 54, the cylinder 51, and the container main body 10 fixed thereto downward. Accordingly, in a case in which the container main body 10 has moved upward due to the user pressing the button part 11, the elastic member 57 may impart an elastic force so that the container main body 10 returns to its original position. For example, the elastic member 57 may be configured as a spring, but the present invention is not limited thereto, and various elastic materials may be used for the elastic member 57 according to embodiments to which the present invention is applied.

In order to return the container main body 10 to its original position, the elastic member 57 may be further disposed at the adhering part 15 described above. That is, at the inner wall of the housing 30, the elastic member 57 may be disposed between the adhering part 15 and a point at which upward movement of the adhering part 15 is suppressed and may push the container main body 10 downward. Of course, the type, installation position, or the like of the elastic member 57 is not particularly limited as long as the elastic member 57 is able to push the container main body 10 in the downward direction in which the container main body 10 exits the housing 30.

FIGS. 5 to 8 illustrate cross-sectional views showing an operational process of the fluid container according to an embodiment of the present invention.

Figure 5:
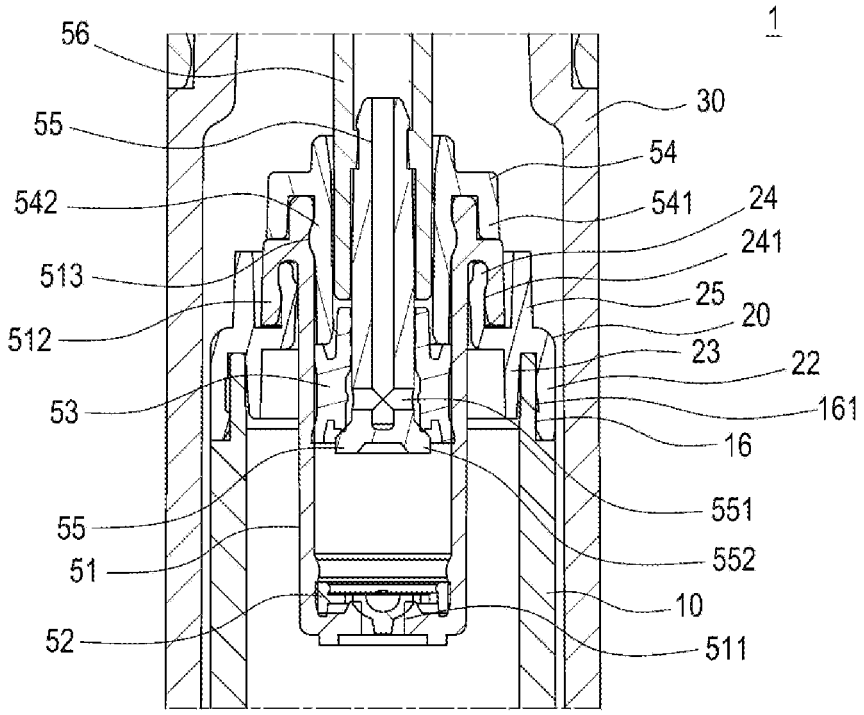
FIG. 5 is a cross-sectional view showing an operational process of the fluid container according to an embodiment of the present invention.

Referring to FIG. 5, the container main body 10, the cylinder 51, and the like are moved downward due to the elastic member 57, and the inlet port 551 of the stem 55 is sealed by the piston 53. Here, the button part 11 of the container main body 10 may protrude toward the lower side of the housing 30.

Figure 6:
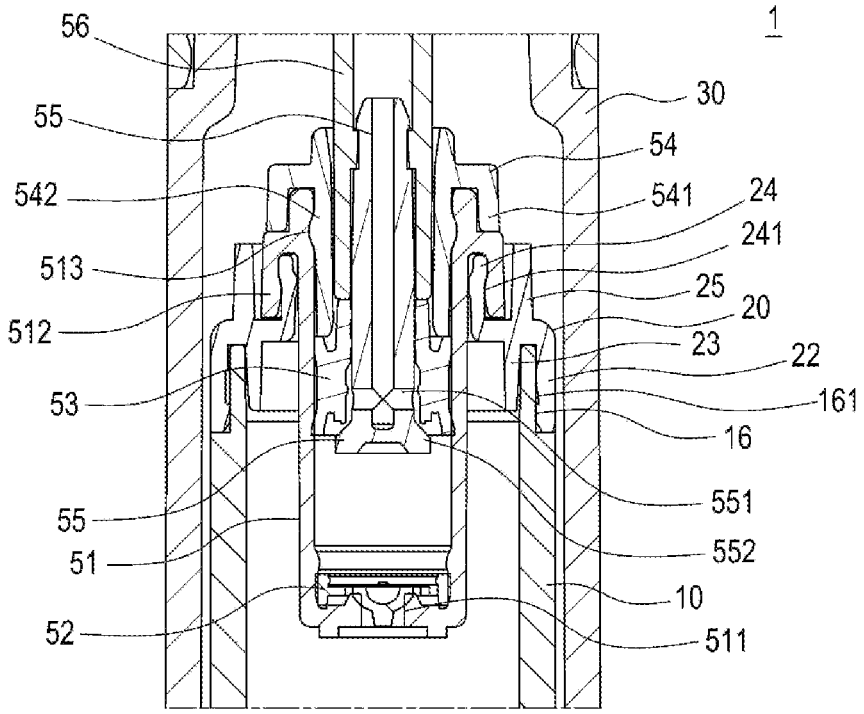
FIG. 6 is a cross-sectional view showing an operational process of the fluid container according to an embodiment of the present invention.

Then, referring to FIG. 6, in a case in which the user presses the button part 11 upward to primarily move the container main body 10 upward, the container main body 10 slides toward the outlet 321 inside the housing 30. Here, the container main body 10 and the cap 20, cylinder 51, and sealing part 54, which are connected to the container main body 10, move upward while the shaft 56 and the stem 55, which are connected to the housing 30, remain in place.

Also, the piston 53 is adhered to the inner wall of the cylinder 51 and may move upward together with the cylinder 51 due to a frictional force. Therefore, since the lower end of the inner surface of the piston 53 is separated upward from the base part 552 of the stem 55, the inlet port 551 of the stem 55 reaches an open state and communicates with the inner space of the cylinder 51.

Figure 7:
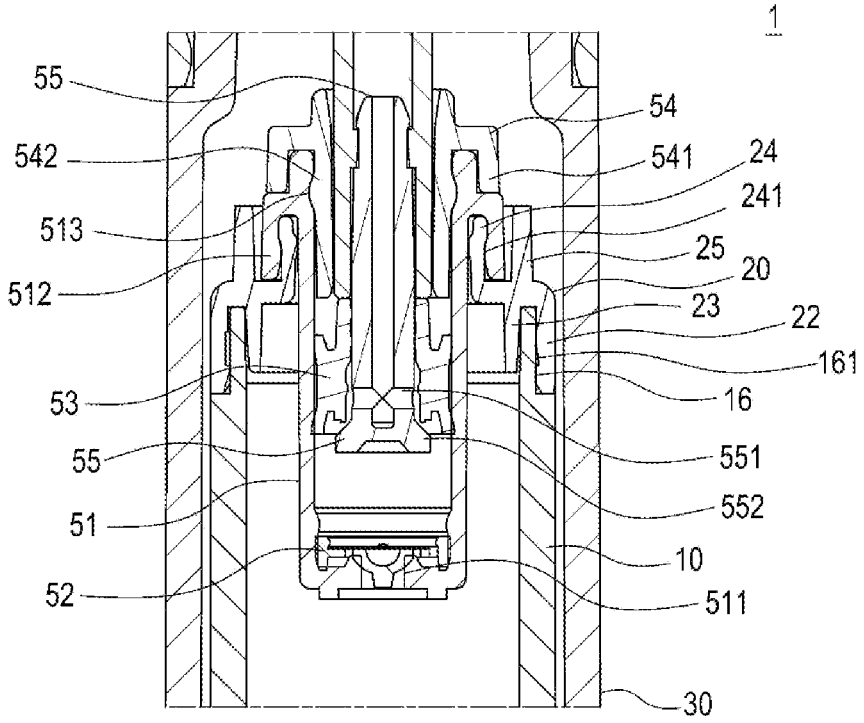
FIG. 7 is a cross-sectional view showing an operational process of the fluid container according to an embodiment of the present invention.

Then, when the user presses the button part 11 further upward to secondarily move the container main body 10 upward, as illustrated in FIG. 7, the container main body 10, the cap 20, the cylinder 51, the sealing part 54, and the like move upward. In this case, unlike the container main body 10, the cylinder 51, and the like, upward movement of the piston 53 is suppressed as the upper end of the piston 53 is engaged with the lower end of the shaft 56. Since the inlet 511 remains sealed by the valve 52, the internal pressure of the cylinder 51 increases. Therefore, the fluid stored in the cylinder 51 may be discharged to the inner portion of the stem 55, the inner portion of the shaft 56, the outlet 321, and the discharge port 331 of the discharge tip 33 through the inlet port 551 due to the positive pressure inside the cylinder 51.

Figure 8:
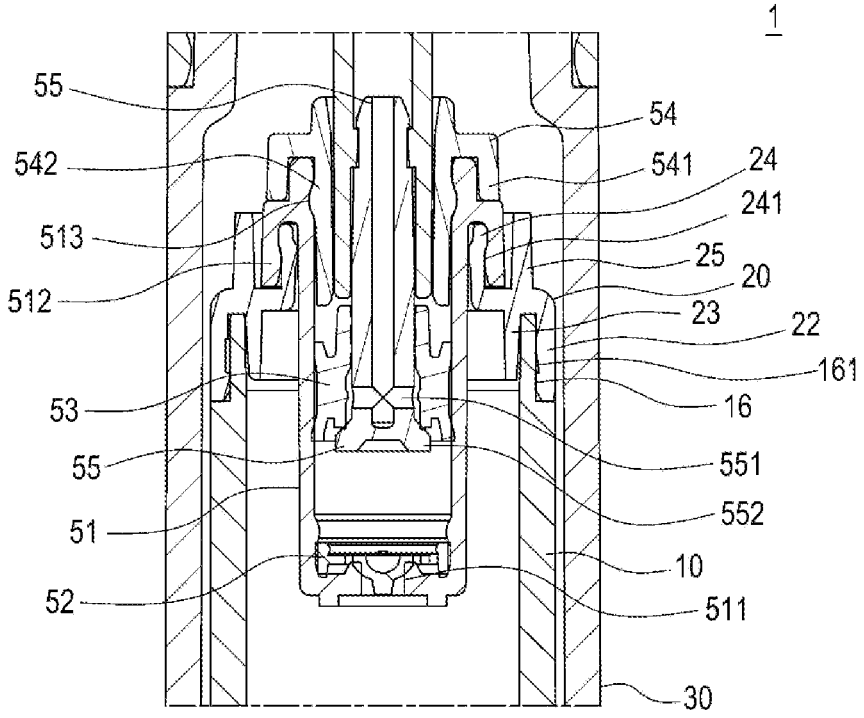
FIG. 8 is a cross-sectional view showing an operational process of the fluid container according to an embodiment of the present invention.

Then, when the user releases the external force applied to the button part 11, as illustrated in FIG. 8, the cylinder 51, the sealing part 54, the cap 20, and the container main body 10 may primarily slide in the direction moving away from the outlet 321 due to the elastic member 57.

Here, since the piston 53 is adhered to the inner wall of the cylinder 51, the piston 53 moves downward together with the cylinder due to the frictional force. However, the downward movement of the piston 53 occurs only until the piston 53 comes in contact with the base part 552 of the stem 55. When the lower end of the piston 53 touches a surface of the base part 552, the inlet port 551 of the stem 55 is sealed. In this case, the inner space of the cylinder 51 and the outlet 321 may be isolated from each other.

Then, when the container main body 10 secondarily slides due to the elastic member 57, as shown in FIG. 5, the cylinder 51 or the like moves further downward in a state in which the inlet port 551 is sealed, and the inlet 511 is opened as the valve 52 is lifted upward due to a decrease in the internal pressure (negative pressure) of the cylinder 51. Therefore, since the fluid inside the container main body 10 may be introduced into the cylinder 51, the cylinder 51 may be filled with the fluid again and be ready to discharge the fluid.

According to the present embodiment, since the fluid container 1 may be manufactured by coupling the pump module 50, in which specific configurations thereof are already assembled, to the container main body 10, the manufacturing cost and manufacturing time may be significantly reduced. In this way, the cost burden on the user may be reduced, and the user's satisfaction may be improved.

Exemplary embodiments of the present invention have been disclosed herein and in the drawings. Here, specific terms have been used, but the terms are only used for the purpose of describing the present invention and are not intended to limit meanings or the scope of the present invention that is stated in the claims below. Therefore, those of ordinary skill in the art should understand that various modifications and other embodiments equivalent to those described herein are possible from the above description. The actual technical scope of the present invention should be defined by the technical idea of the claims below.

The invention claimed is:

1. A fluid container comprising:

a container main body, of which an upper side is open, configured to store a fluid;

a housing having an outlet provided at an upper side thereof and in which the container main body slides in a longitudinal direction;

a cap coupled to the open upper side of the container main body and having an opening; and a pump module coupled to the opening of the cap and disposed between the cap and the outlet and configured to discharge the fluid to the outlet by sliding the container main body, wherein the cap comprises:

a pump coupling part that protrudes from a circumference of the opening of the cap toward the outlet; and a circumferential part spaced apart from and protruding along a circumference of the pump coupling part, wherein the circumferential part protrudes further toward the outlet than the pump coupling part and has an inclined inner surface in which an inner diameter thereof gradually decreases toward a lower side thereof, and wherein the pump module includes an edge part disposed along a circumference thereof, and as the pump module is inserted into the opening of the cap, the edge part engages with the pump coupling part to couple the pump module and the cap, and the circumferential part guides the coupling of the pump module and the cap by guiding the edge part of the pump module through the inclined inner surface of the circumferential part.

2. The fluid container of claim 1, wherein the pump module comprises:

a cylinder coupled to the opening of the cap and having an inlet communicating with an inner portion of the container main body;

a piston provided at an inner wall of the cylinder;

a sealing part coupled to a circumference of an upper end of the cylinder to suppress upward movement of the piston;

a stem having an inlet port, which is opened and closed by the piston, formed at one end and which is connected to the outlet of the housing; and an elastic member configured to provide an elastic force to the sealing part in a direction moving away from the outlet, wherein the pump module is coupled to the opening of the cap in a state in which the cylinder and the sealing part are coupled.

3. The fluid container of claim 2, wherein the container main body includes a button part exposed to an outside of the housing and configured to be pressed to allow the sliding of the container main body.

4. The fluid container of claim 3, wherein the pump module further comprises a shaft coupled to the stem to integrally move up and down with the stem and fitted to the outlet.

5. The fluid container of claim 3, wherein, in the pump module, when the button part is pressed and thus the container main body slides toward the outlet, the inlet port is opened as the cylinder and the piston move upward, and then, due to an increase in an internal pressure of the cylinder, the fluid in the cylinder is discharged to the outlet via the stem.

6. The fluid container of claim 3, wherein, in the pump module, when pressing on the button part is released, as the container main body slides in the direction moving away from the outlet due to the elastic member, the inlet port is sealed as the cylinder and the piston move downward, and then, due to a decrease in an internal pressure of the cylinder, the fluid inside the container main body is introduced into the cylinder.

* * * * *